United States Patent [19]

Widder

[11] Patent Number: 5,072,453

[45] Date of Patent: Dec. 17, 1991

[54] BODY PROTECTION SYSTEM

[76] Inventor: Nathaniel Widder, #South Farragut St., Philadelphia, Pa. 10129

[21] Appl. No.: 490,294

[22] Filed: Mar. 8, 1990

[51] Int. Cl.[5] ..... F41H 1/02

[52] U.S. Cl. ..... 2/2.5; 2/102; 2/326; 2/248

[58] Field of Search ..... 2/2.5, 102, 51, 52, 2/326, DIG. 6, 2, 247, 248, 249, 250, 253; 428/911

[56] References Cited

U.S. PATENT DOCUMENTS

| | | | |
|---|---|---|---|
| 2,517,615 | 8/1950 | Webster et al. | 2/2.5 |
| 2,592,087 | 4/1952 | Wallace | 2/247 |
| 2,748,391 | 6/1956 | Lewis, Jr. et al. | 2/2.5 |
| 3,010,111 | 11/1961 | Ralph | 2/248 |
| 3,029,442 | 4/1962 | Aielli | 2/249 |
| 3,061,839 | 11/1962 | Foster | 2/2.5 |
| 3,392,406 | 7/1968 | Pernini et al. | 2/2.5 |
| 3,451,065 | 6/1969 | Augustin | 2/247 |
| 3,634,889 | 1/1972 | Rolsten | 2/2.5 |
| 3,783,449 | 1/1974 | Davis | 2/2.5 |
| 4,316,286 | 2/1982 | Klein | 2/2.5 |
| 4,497,069 | 2/1985 | Braunhut | 2/2.5 |
| 4,774,724 | 10/1988 | Sacks | 2/2.5 |

FOREIGN PATENT DOCUMENTS

| | | | |
|---|---|---|---|
| 64089 | 11/1945 | Denmark | 2/2.5 |

*Primary Examiner*—Werner H. Schroeder
*Assistant Examiner*—Michael A. Neas
*Attorney, Agent, or Firm*—Terry M. Gernstein

[57] ABSTRACT

A body protection system includes a suspender-like cage unit which is worn by a user and which includes various releasably attaching elements thereon. Bullet-proof plates are removably contained in pocket elements that are releasably attached to the cage unit at various locations to protect various and selected areas of the wearer's body while leaving other areas of the wearer's body unprotected.

2 Claims, 6 Drawing Sheets

BODY PROTECTION SYSTEM

TECHNICAL FIELD OF THE INVENTION

The present invention relates to the general art of wearing apparel, and to the particular field of protective body armor.

BACKGROUND OF THE INVENTION

There has been a rapid increase in gun-related deaths and injuries to private citizens, government officials and policemen in recent times. The policeman in particular is especially vulnerable to injury due to gun-related violence. This problem has become so prevalent that many areas of certain cities remain unprotected because police, fireman and other such officials are afraid to enter such areas.

Other than simply leaving such areas totally unprotected, some cities have approached the problem by requiring policemen, firemen and other such officials to wear bulletproof vests when entering such areas.

While the bulletproof vest does provide some protection, these vests must be quite heavy in order to provide protection to a wearer, especially in light of the high powered weapons now commonly possessed by street criminals.

Not only are such heavy vests expensive, such vests are generally cumbersome, hot, uncomfortable and difficult to clean. Most policemen can accept some of the problems, however, if he is encumbered and cannot move as rapidly or as freely as necessary, he may actually be endangered by the vest.

Still further, some situations do not require a wearer to be fully protected against a powerful weapon. Some situations may only require light protection. However, most known bulletproof vests are not adaptable to diverse situations. Such unadaptability further inhibits the full use of such protective clothing. Since each situation may differ from others, it is difficult to foresee exactly what type of protection will be needed or desired by the person who will be exposed to that situation. Since the present bulletproof vests are not adaptable, a wearer cannot fully exercise his own judgement in a given situation as to a balance between the amount of protection provided and other factors, such as freedom of movement, comfort, or the like.

Still further, some wearers and potential wearers are smaller than others, and the present bulletproof vests are not fully adaptable to different size wearers, especially for children. Since children should also be protected, the inability of such vests to adapt to different sizes and situations presents a serious drawback to the full use of bullet proof clothing. In the case of children, problems associated with the size inadaptability of present bulletproof clothing are exacerbated by the also-mentioned problems associated with the inhibiting nature of many such vests and the problems associated with cleaning such vests.

Therefore, there is a need for an article of clothing that will protect a wearer against gun-related injury or death, but which is adaptable to various situations and wearer sizes, and which can be expeditiously cleaned as well as being easy to wear while still providing as much protection as the wearer desires so the wearer can judge how much protection he wants in a given situation.

OBJECTS OF THE INVENTION

It is a main object of the present invention is to provide an article of clothing that will protect a wearer against gun-related injury or death.

It is another object of the present invention to provide an article of clothing that will protect a wearer against gun-related injury or death, but which is adaptable to various situations and wearer sizes.

It is another object of the present invention to provide an article of clothing that will protect a wearer against gun-related injury or death, but which is adaptable to various situations and wearer sizes, and which can be expeditiously cleaned.

It is another object of the present invention to provide an article of clothing that will protect a wearer against gun-related injury or death, but which is adaptable to various situations and wearer sizes, and which can be expeditiously cleaned as well as being easy to wear.

It is another object of the present invention to provide an article of clothing that will protect a wearer against gun-related injury or death, but which is adaptable to various situations and wearer sizes, and which can be expeditiously cleaned as well as being easy to wear while still providing as much protection as the wearer desires so the wearer can judge how much protection he wants in a given situation.

SUMMARY OF THE INVENTION

These, and other, objects are achieved by a protection system that includes a basic suspension system which can be changed and modified as needed to effect cleaning or to adapt the protection system to a given situation. The size of the suspension system can be altered, and the suspension system includes means for attaching large or small protection elements thereto.

Specifically, the suspension system is suspender-like in appearance and includes various belts, and straps as well as hooks and hook-and-loop fastener systems so that various other belts and pads can be detachably mounted on the suspension system to increase the overall protection as well as to localize certain protection, while eliminating other protection if desired.

Using this system, a user can select, for example, to protect only the heart, kidney, and liver areas while leaving the stomach areas unprotected so that full freedom of movement is obtained while sacrificing certain protection. The trade-off of certain protection areas for freedom of movement is a choice that should be left to the wearer as that wearer is exposed to the situation.

The system also includes size adjusting elements, and thus can be sized to fit large or small wearers, and since the amount of protection can be varied, the small wearer will not be encumbered as much due to a necessity to wear the same volume of protection as is needed by a large person. This permits the same system to be used by children as well as adults.

The bulletproof elements of the system embodying the present invention are removably stored in pocket elements that are releasably mounted on the suspender-like system. To clean the system, the bulletproof elements are simply removed from the pockets and the rest of the system washed as suitable. The bulletproof elements are then replaced in the pockets, and certain ones of the pockets are then re-attached to the suspenders to protect the wearer as desired.

Since the wearer need only wear the amount of protection desired, and the suspension system is suspender-like, the article of clothing is cool and does not overly-encumber movements of the wearer.

BRIEF DESCRIPTION OF THE DRAWING FIGURES

DETAILED DESCRIPTION OF THE PREFERRED EMBODIMENT OF THE INVENTION

Figure 1:
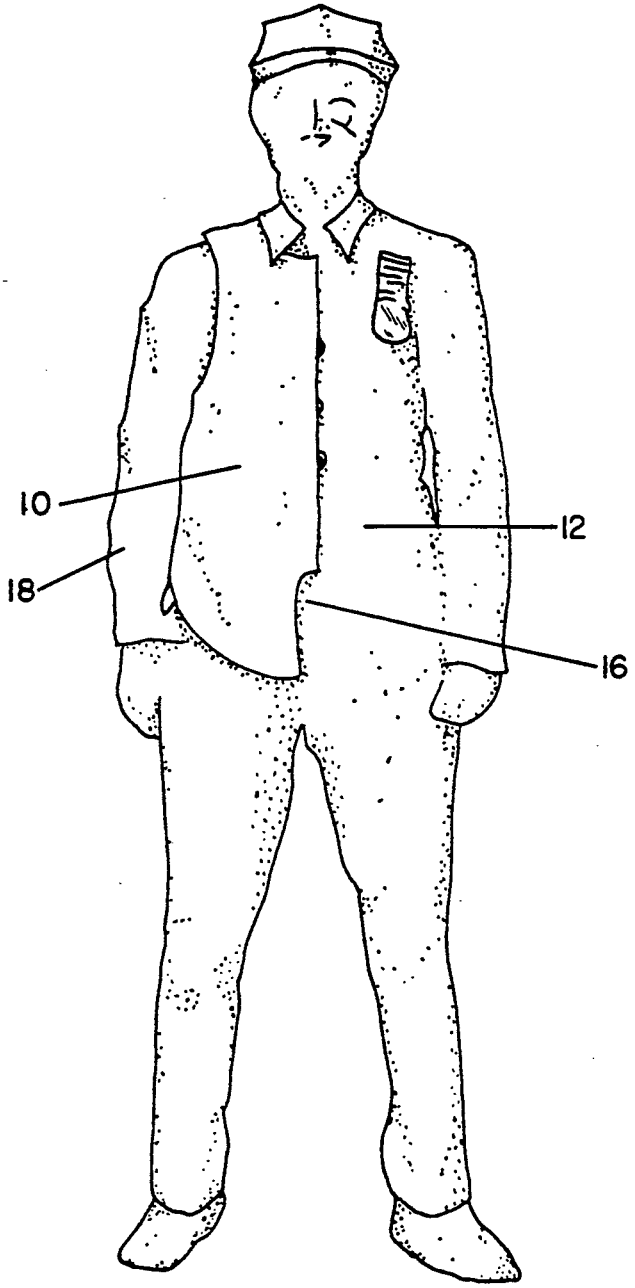
FIG. 1 (PRIOR ART)
FIG. 1 is a front elevational view of a policeman wearing a prior art bulletproof vest.
Figure 17:
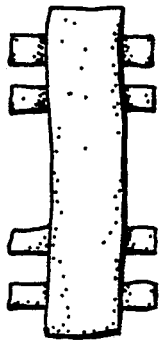
FIGS. 9–17 show elements that can be used in conjunction with the suspension system of the present invention.
Figure 12:
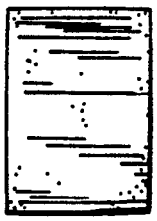
Figure 13:
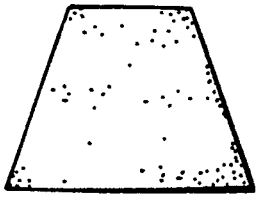

Shown in FIG. 1 is an example of a prior art bulletproof vest 10 being worn by a policeman under his summer blouse 12 and uniform belt 16. The vest can be worn over his shirt 18, but is still likely to be hot and cumbersome to wear. The vest is also likely to be heavy and not adaptable to being varied as the situation demands, nor is such a vest suitable for use by small children or other small individuals.

Accordingly, the present invention is embodied in a body protection system that can be varied to adapt to different situations, as well as be easily removed for cleaning and the like.

Figure 2:
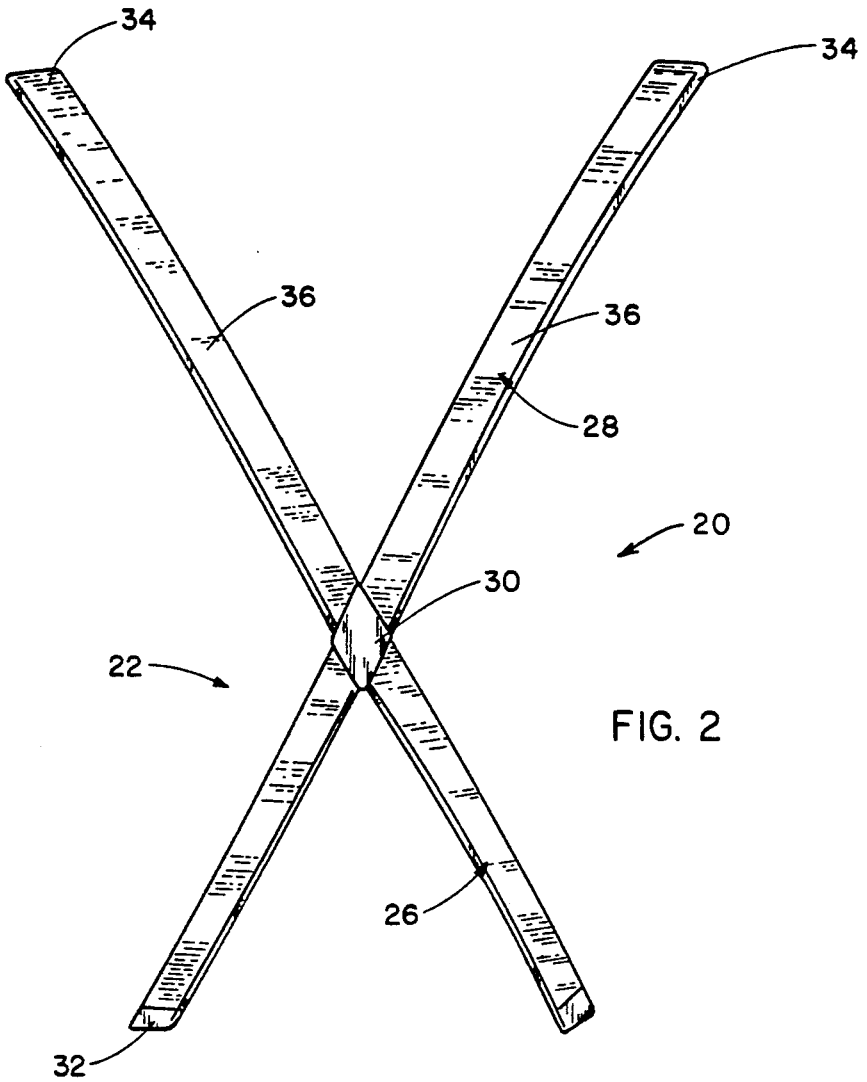
FIG. 2 is a rear view of a portion of the suspension system of the body protection system embodying the present invention.
Figure 8:
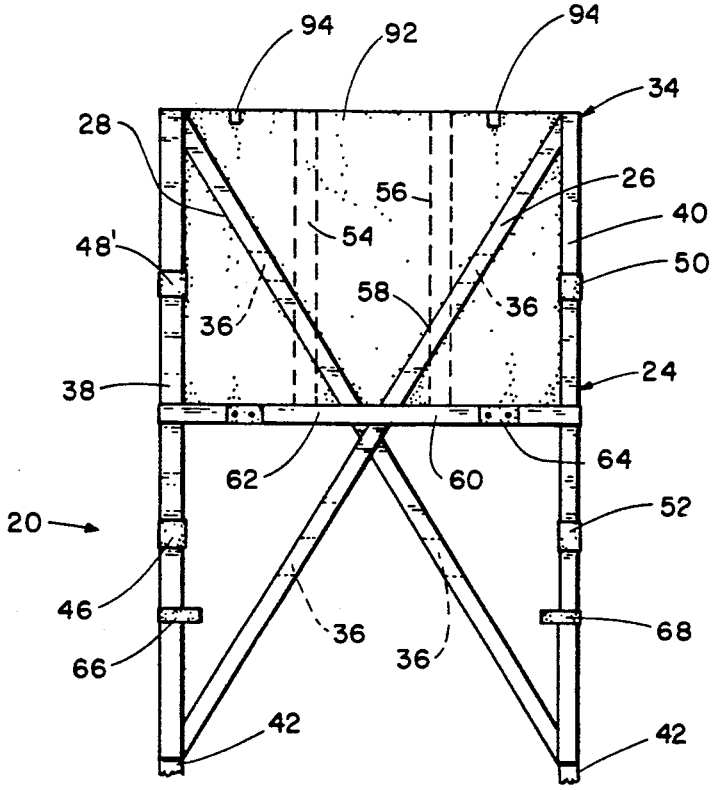
FIG. 8 is a front elevational view of the overall suspension system of the protection system.

The system includes a basic suspension system, best shown in FIGS. 2, and 8 as including a suspenders-like cage 20 that fits over the upper torso and trunk of a wearer. The cage 20 is lightweight and can be adjusted to fit various size wearers, and includes a posterior section 22 and an anterior section 24. The posterior section includes first and second crossed straps 26 and 28 that intersect each other and are coupled together by a stitched element 30 in the manner of suspenders. The straps include clips 32 on one end thereof for releasably coupling these straps to the wearer's belt or other article of clothing. The straps extend diagonally across the user's back and extend across the user's shoulders near the superior sections 34 of each strap.

Each of the straps 26 and 28 has attaching means, such as hook-and-loop fastener means 36 thereon to attach other protective elements to the cage as will be apparent from the ensuing disclosure.

The cage further includes a right strap 38 and a left strap 40 extending anteriorly of the wearer when the cage is in place. The right strap 38 is connected at a superior portion thereof to the superior end of the strap 28 and has a clip element 42 attached thereto at an inferior end whereas the left strap 40 is connected at a superior portion thereof to the superior end of the strap 26 and has a clip element 42 on an inferior end thereof. The clip elements 42 releasably attach the cage to the wearer's belt or pants in the manner of suspenders.

Each anterior strap also includes various releasable fastener elements thereon, such as inferior and superior hook-and-loop fasteners 46 and 48, respectively, on strap 38 and inferior and superior fasteners 50 and 52 on strap 40. Other similar fastener elements are also located on the underside of the straps. The various fastener elements are used to releasably attach various other body protecting elements to the cage.

Additional support is provided by additional support straps 54 and 56 which are each connected at a posterior end 58 thereof to one of the anterior straps 26 and 28 and have an anterior end 60 releasably attached to a thorax-spanning and abdomen-spanning belt 62 that is, itself, releasably attached at its right and left ends to the right and left anterior straps 38 and 40 respectively. The releasable coupling of the straps and belt is preferably effected using the aforementioned hook-and-loop fastening means. The belt 62 also includes releasable attaching means, such as hook-and-loop means 64 so that still further body protecting elements can be releasably attached to the cage.

Size adjusting means 66 and 68 are also included on the right and left straps 38 and 40 respectively. The size adjusting means are preferably similar to such elements used on suspenders.

Figure 3:
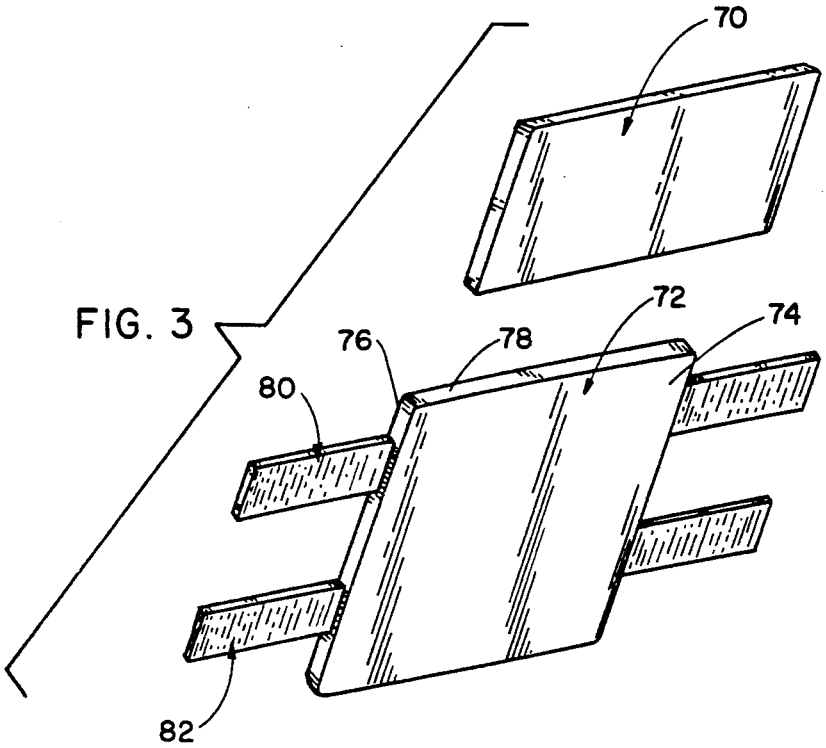
FIG. 3 is a perspective view of a pocket element used in the body protection system of the present invention.
Figure 4:
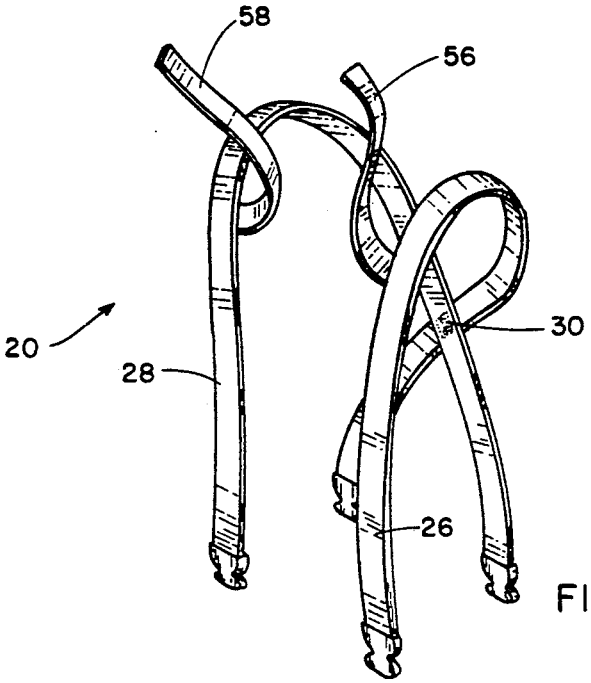
FIG. 4 is a rear view of a portion of the suspension system including additional supporting elements.
Figure 5:
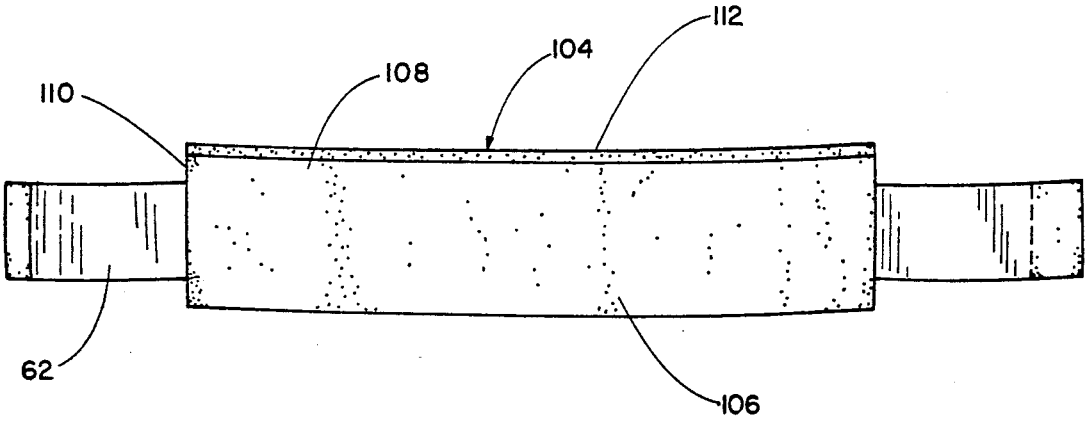
FIG. 5 is a front elevational view of a belt and lap protection element which can be used in the overall protection system of the present invention.
Figure 15:
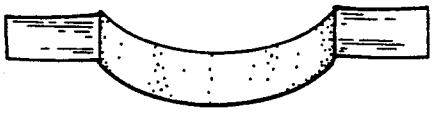
Figure 16:
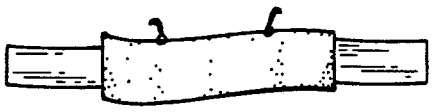

Various bulletproof elements are attached to the cage at various locations thereon. Each of these bulletproof elements preferably includes a plate 70 of heavy bulletproof metal, Kelvar or the like, such as indicated in FIG. 3. The plates are positioned adjacent to the user's body by pocket support elements, such as element 72 having a front wall 74 and a rear wall 76 coupled together at the ends and bottoms thereof to define a pocket 78 into which the plate 70 is received. The pocket element is supported on straps, such as straps 80 and 82 shown in FIG. 3 that are either sewn to the pocket element or inserted through loops (not shown in FIG. 3) attached to one of the walls 74 or 76. If loops are used, the lateral position of the pocket can be adjusted, and if the straps are sewn to the pocket element, the straps can have length adjusters, such as the adjusters 66 and 68 so the lateral position of the pocket element can be adjusted to correspond to the desires of the user.

Protective pockets such as the element 72, can be attached to the belt 62 via fastener elements on the pocket element which co-operate with the fasteners 64, or the straps 80 and 82 can be used in place of the belt 62 as suitable. Elements, such as element 72, can also be attached at various locations on various straps of the cage as will occur to those skilled in the art from the present disclosure. Such pocket elements can thus be attached at fastener means 46, 48, 50 and 52 as well as fastener means 36 and on the straps 54 and 66. Thus, vital organs can be protected as desired, yet the overall weight of the assembly can be kept low by omitting protection of other areas of the user's body.

Figure 6:
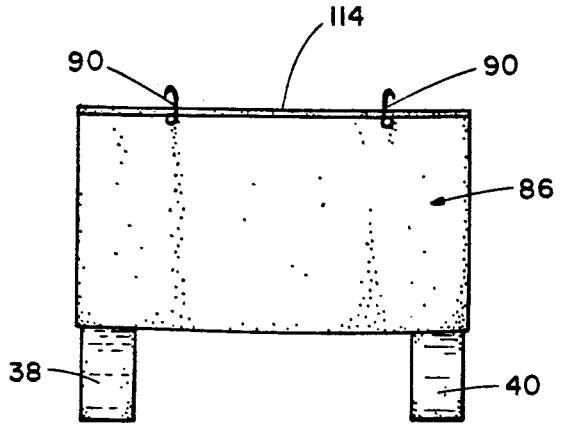
FIG. 6 is a back protection element that can be added to the protection system of the present invention.
Figure 7:
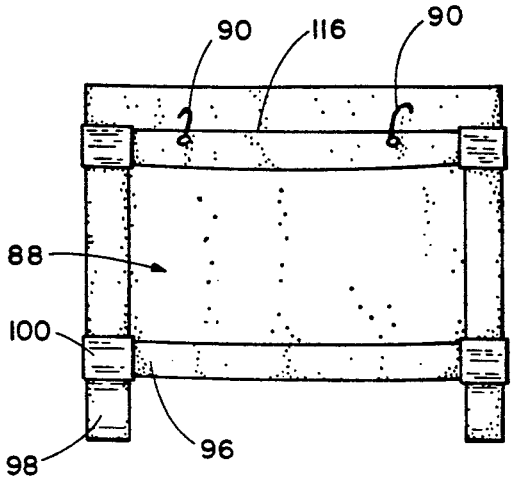
FIG. 7 is a chest protection element that can be added to the protection system of the present invention.

Further protection for the user is provided by chest protector element 86 shown in FIG. 6 and/or by back protector element 88 shown in FIG. 7. The chest and back protector elements include bulletproof plates, similar to plate 70, removably held in pocket elements, similar to the element 72 and span the chest or back area of the user. The chest and back protector elements also include hooks 90 which releasably attach the pocket elements to a shoulder strap 92 that spans the collarbone area of the user subadjacent to the user's neck and which has loops 94 thereon into which the hooks 90 fit to pendently support the chest or back protector elements on the cage. The pocket elements associated with the chest and back protectors can also include straps, such as lateral straps 96 and vertical straps 98 having hook-and-loop fastener means, such as means 100, thereon. These straps can be coupled to the other cage straps, as by hook-and-loop fastener means on the ends of the straps 96 and 98 co-operatingly engaging hook-and-loop fastener means on the straps 26, 28, 38 and/or 40 as well as straps 92, 62, 80, 82 and the like of the cage. Alternatively, the pocket elements associated with the back or chest protectors can be attached directly to the cage straps, such as indicated in FIG. 6 with the pocket element 86 being mounted on straps 38 and 40 by the fasteners 48 and 50 cooperating with fasteners on the pocket element 86.

The belt 62 can include a pocket element 104 that is attached to the belt by hook-and-loop fasteners cooperating with the fasteners 64 to protect the user's abdominal area. The belt 62 can also completely encircle the user and can include an element 104 on the back of the user to protect his kidneys if desired. The pocket element 104 is similar to the above-described pocket element 72 and thus includes a front wall 106 attached to a back wall along all edges except top edge 108 to form a pocket into which a bulletproof plate is fit. The pocket elements can also have all edges connected to securely encase the plate elements if desired. Also, any or all of the pocket elements can have an opening defined along one end edge, such as end edge 110 on element 106 with the top edge 108 being sewn shut. The bulletproof plate is moved into and out of the pocket through the opening defined at the appropriate edge.

If suitable, any or all of the pocket elements can include a steel support bar, such as bar 112 attached to pocket element 106, bar 114 attached to element 86 or bar 116 attached to element 88.

As can be concluded from the above disclosure, the user can decide for himself what protection is used and how much is used. The user simply puts on the cage 20 and modifies it according to his desires to protect those areas that are needed in the situation at hand. The size adjusters can be used to size the overall cage and pockets to the exact needs of the user. Once the user is finished wearing the device, he can remove the bulletproof plates from the pockets and launder the cage, the belts and the pocket elements. The device can be kept in a small container or area for storage, and assembled as necessary.

Figure 9:
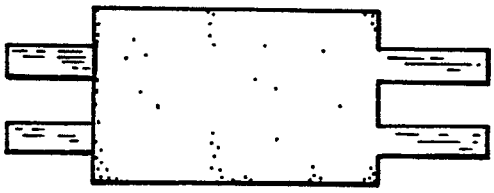
Figure 10:
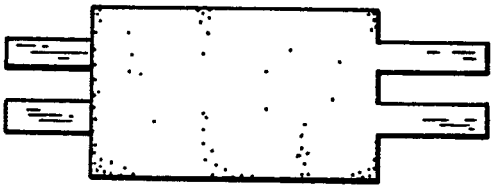
Figure 11:
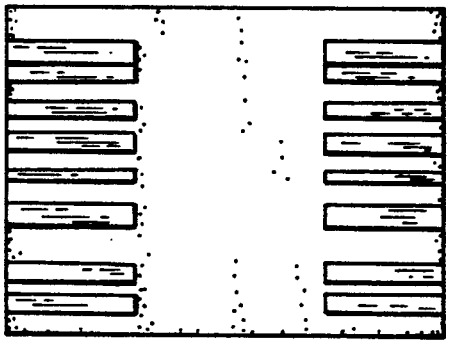
Figure 14:
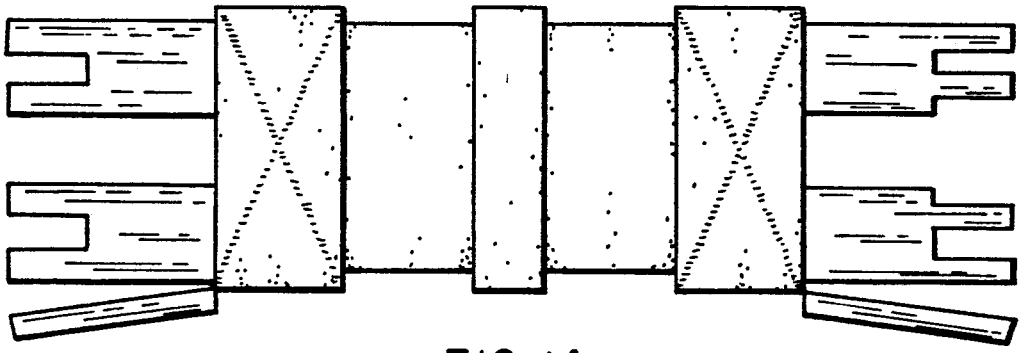
Figure 18:
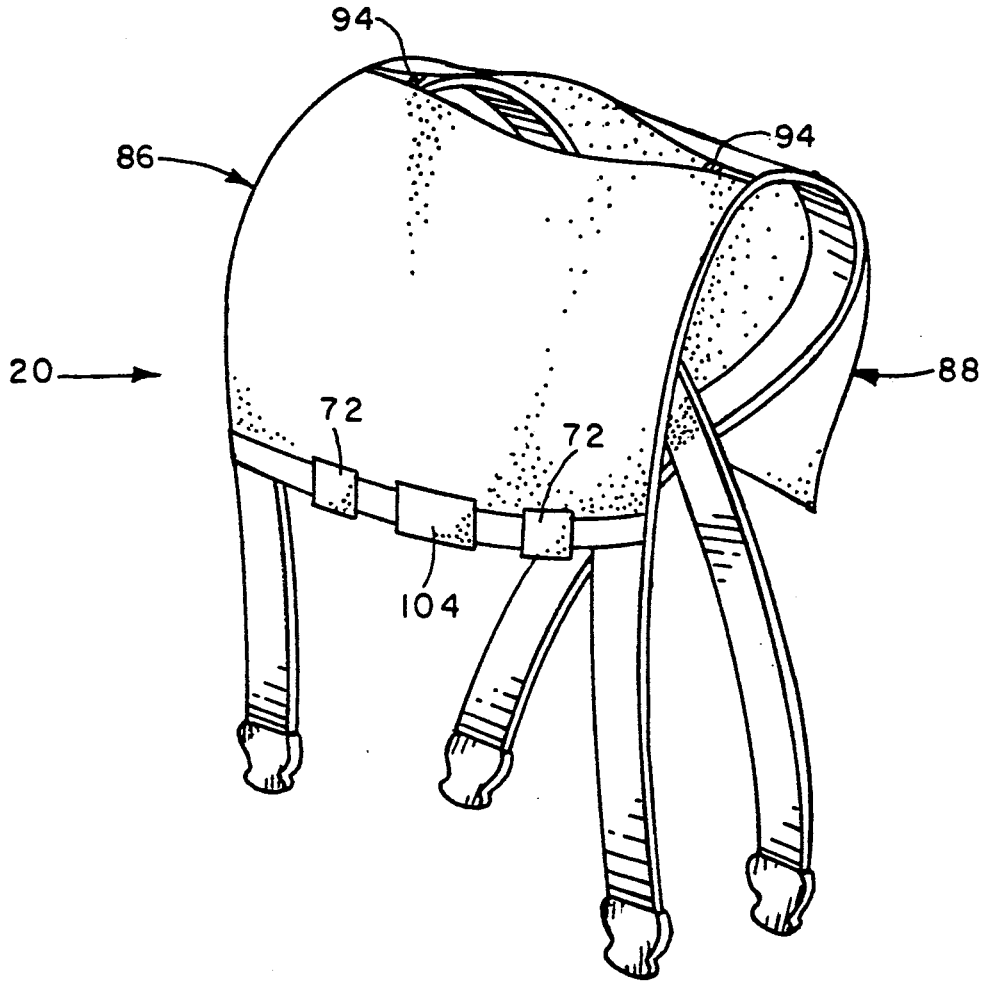
FIG. 18 is a perspective view of the overall device in the assembled configuration.

Shown in FIGS. 9–17 are various elements that can be used to protect various portions of the user's body. An assembled perspective view is shown in FIG. 18. These elements are simply hung onto the suspension system using the aforementioned hook-and-loop fasteners. Thus, the heart, kidneys, and the liver can be protected using an element such as shown in FIGS. 9 and 10, the back lung area can be protected using the element shown in FIG. 13, while the underarm area can be protected using the element shown in FIG. 12. The dual strap belt shown in FIG. 14 can also be used to hang various elements on, and the stomach area can be protected using the element shown in FIG. 15 while the collarbone area can be protected using the element shown in FIG. 16, and the spine can be protected by the element shown in FIG. 17. As seen, any amount of protection can be used by simply adding various protective elements to the basic suspsension system. All of the various elements are stored in pockets that have hook-and-loop fastening means thereon, with the pockets being attached to the suspension system as above described.

It is understood that while certain forms of the present invention have been illustrated and described herein, it is not to be limited to the specific forms or arrangements of parts described and shown.

I claim:

1. A body protection system comprising:

A) a suspension unit which fits over a trunk section of a user and which includes (1) a suspenders-like cage having (a) a first posterior strap extending diagonally across a user's back when the suspension unit is in place on the user, said first posterior strap including a superior end located adjacent to a user's shoulder when the suspension unit is in place on the user, and a bottom end, (b) a second posterior strap extending diagonally across the user's back when the suspension unit is in place on the user and which intersects said first posterior strap, said second posterior strap including a superior end located adjacent to the user's shoulder when the suspension unit is in place on the user, and a bottom end, (c) a connecting means connecting said first and second straps together at the intersection of said first and second straps, (d) attachment means on the bottom end of each of said posterior straps for releasably attaching said posterior straps to clothes of the user, (e) a right anterior strap having a superior end connected to the superior end of said first posterior strap and a bottom end, said right anterior strap extending downwardly over the user's chest when the cage unit is in place on the user, (f) a left anterior strap having a superior end connected to the superior end of said second posterior strap and a bottom end, said left anterior strap extending downwardly over the user's chest when the cage unit is in place on the user, (g) attachment means on the bottom end of each anterior strap for releasably attaching said anterior straps to clothes of the user, and (h) a waist belt having one end thereof releasably attached to said right anterior strap and another end thereof releasably attached to said left anterior strap and extending laterally across a user's abdominal area when the cage unit is in place on the user, said waist belt including a lap protector element releasably mounted thereon;

B) additional support belts releasably attached to said cage unit and including (1) a shoulder belt having one end thereof releasably attached to said right anterior strap and another end thereof releasably attached to said left anterior strap and extending laterally across a user's chest area adjacent to the user's throat when the cage unit is in place on the user, (2) a back protector releasably attached to said posterior straps, (3) a chest protector releasably attached to said anterior straps, (4) a first additional strap extending over one of the user's shoulders and having one end thereof releasably attached to said first posterior strap and having another end thereof releasably attached to said right anterior strap, and (5) a second additional strap extending over another one of the user's shoulders and having one end thereof releasably attached to said second posterior strap and having another end thereof releasably attached to said left anterior strap;

C) releasable attaching means on each of said anterior straps, on each of said posterior straps, on said first and second additional straps, on said waist belt, on each of said additional support belts, on said shoulder belt, on said back protector and on said chest protector, said releasable attaching means including hook-and-loop fastening means; and D) pocket support elements releasably attached to said anterior and to said posterior straps, each of said pocket support elements including (1) a front wall, (2) a rear wall, (3) said front and rear walls being connected together along edges of said walls, with one edge on said front wall being unconnected to a corresponding edge of said rear wall so that said front and rear walls define a pocket, (4) hook-and-loop fastening means on said pocket element rear wall, and (5) a steel bar attached to each pocket element; and E) a bulletproof plate located in each pocket element.

2. The body protection system define in claim 1 further including sizing means on each of said anterior straps.

* * * * *